US005421638A

United States Patent [19]

Ayotte et al.

[11] Patent Number: 5,421,638

[45] Date of Patent: Jun. 6, 1995

[54] SEAT ATTACHMENT

[75] Inventors: John Ayotte, Eagan; Peter W. A. Bergin, Hopkins, both of Minn.

[73] Assignee: MTS Northwest Sound, Inc., Minneapolis, Minn.

[21] Appl. No.: 25,374

[22] Filed: Feb. 26, 1993

[51] Int. Cl.[6] ..... A47C 7/62

[52] U.S. Cl. ..... 297/188.04; 297/248; 248/312.1; 248/295.1; 224/42.45 R

[58] Field of Search ..... 297/191, 188, 248, 232; 248/312, 312.1, 295.1; 224/42.45 R

[56] References Cited

U.S. PATENT DOCUMENTS

| | | | |
|---|---|---|---|
| D. 307,852 | 5/1990 | Clark | D7/620 |
| D. 328,223 | 7/1992 | Clark | D7/619 |
| 1,149,541 | 8/1915 | Rees | 297/191 |
| 1,680,469 | 8/1928 | Morgan | 248/295.1 |
| 2,132,331 | 10/1938 | Wanamaker | 297/232 |
| 2,319,109 | 5/1943 | Bulloch | 248/295.1 |
| 2,471,030 | 5/1949 | Foulke | 224/42.45 R |
| 2,706,516 | 4/1955 | Nordmart | 297/191 |
| 2,807,315 | 9/1957 | Manne | 297/191 |
| 3,041,107 | 6/1962 | Schaefer | 297/248 |
| 3,172,713 | 3/1965 | Rupert | 297/191 |
| 3,565,384 | 2/1971 | Lockwood | 248/312 |
| 4,865,237 | 9/1989 | Allen | 224/42.45 R |
| 5,320,319 | 6/1994 | Winger et al. | 248/312.1 |

FOREIGN PATENT DOCUMENTS

| | | | |
|---|---|---|---|
| 2729565 | 1/1978 | Germany | 297/232 |

*Primary Examiner*—Peter R. Brown
*Assistant Examiner*—David E. Allred
*Attorney, Agent, or Firm*—Westman, Champlin & Kelly

[57] ABSTRACT

A seat attachment capable of being mounting on the standard of a seat. The seat attachment comprises a container holder, a first flexible arm extending from the container holder and a second flexible arm extending from the container holder. A first mounting bracket is located at a first end of the first arm and a second mounting bracket is located at a first end of the second arm. The seat attachment is mounted on the seat through the use of a plurality of bolts, each of which is inserted through a hole in one of the mounting brackets, through a hole in the standard, and into a corresponding hole in the seat. When the bolts are tightened, the first and second arms substantially conform to the shape of the seat on which they are mounted.

14 Claims, 4 Drawing Sheets

Fig. 5
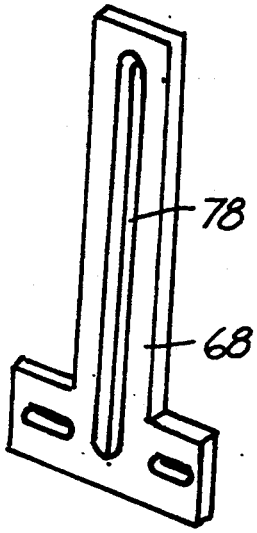
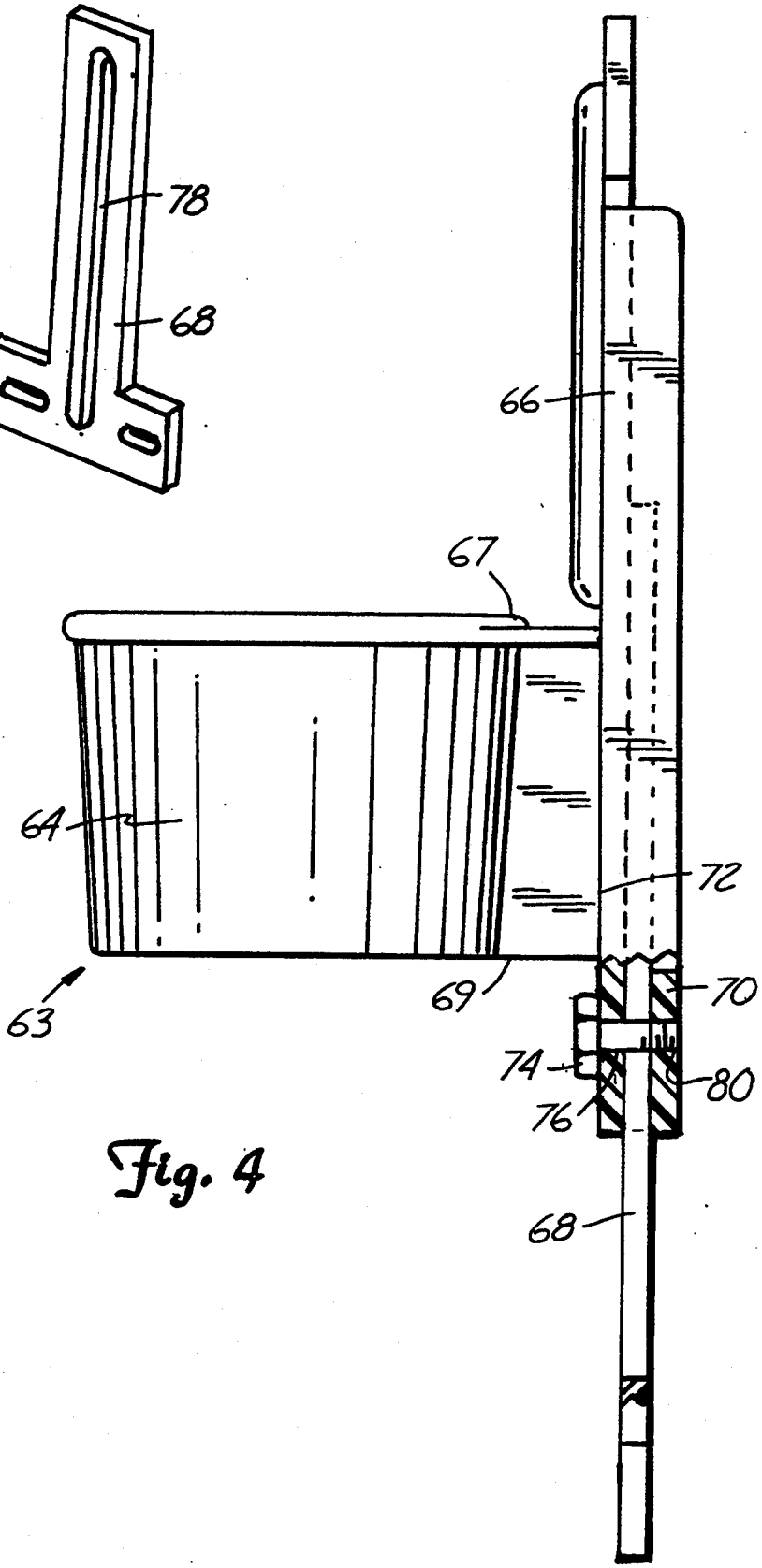
Fig. 4

SEAT ATTACHMENT

BACKGROUND OF THE INVENTION

The present invention relates to a seat attachment having a container holder which can be mounted on the standard of a seat and, in particular, to a seat attachment which can be mounted on the standard of a seat in a manner that prevents the container holder from protruding into the aisle behind the seat.

In stadiums, arenas and theaters, a common problem is the lack of a place to rest beverage or popcorn containers. Often, containers are placed on the floor or on the arm of the seat, only to be accidentally knocked over or otherwise spilled. In the alternative, the occupant of a seat must hold the containers, thereby restricting the use of his hands.

A number of types of container holders have been used to alleviate this problem. Among those are various container holders that are adapted to be mounted to the back of a seat. Container holders of this type often protrude into the aisle behind the seat. In addition, many such container holders are limited to being mounted on only one type of seat or standard and cannot be adapted to be mounted on other types of seats. Further, in mounting such container holders, bolts are used which must be provided and which require the drilling of additional holes in the seat back.

There is therefore a need for a container holder which can be mounted on a seat in a manner which substantially prevents it from protruding into the aisle behind the seat. It would be beneficial for the container holder to be able to be mounted without drilling any additional holes in the seat and without the use of any new hardware.

SUMMARY OF THE INVENTION

The present invention provides a seat attachment which can be mounted on the standard of a seat. The seat attachment comprises a container holder having a first end and a second end, a first flexible arm extending from the first end of the container holder, and a second flexible arm extending from the second end of the container holder. A first mounting bracket is located at an end of the first arm furthest from the container holder and a second mounting bracket is located at an end of the second arm furthest from the container holder.

The seat attachment is mounted on the seat through the use of the bolts used to attach the seat back to the standard. Each bolt extends through a mounting hole in one of the mounting brackets, through a hole in a portion of the standard, and into a corresponding hole in the seat. Upon tightening the bolts, the first arm and the second arm will bend or flex to generally conform to the shape of the seat on which the seat attachment is mounted. In addition, the first and second mounting brackets will bend or flex to conform to the portion of the standard to which they are attached.

The second arm can be designed such that it is adjustable in length. In such an arrangement, a sleeve is attached to one side of the container holder and the second arm is inserted therein. The distance that the second arm extends from the container holder can be varied by sliding the second arm in the sleeve, enabling the seat attachment to be used with a variety of standards. A tightening bolt extends through a hole in the sleeve, through a slot in the second arm, and into a second hole in the sleeve. The tightening bolt can be tightened to rigidly hold the second arm in the sleeve after the second arm is adjusted to a desired length.

BRIEF DESCRIPTION OF THE DRAWINGS

FIG. 4 is a side view of a modified form of the seat attachment of the present invention; and FIG. 5 is a perspective view of a portion of the modified form of the seat attachment.

DETAILED DESCRIPTION OF THE PREFERRED EMBODIMENTS

Figure 1:
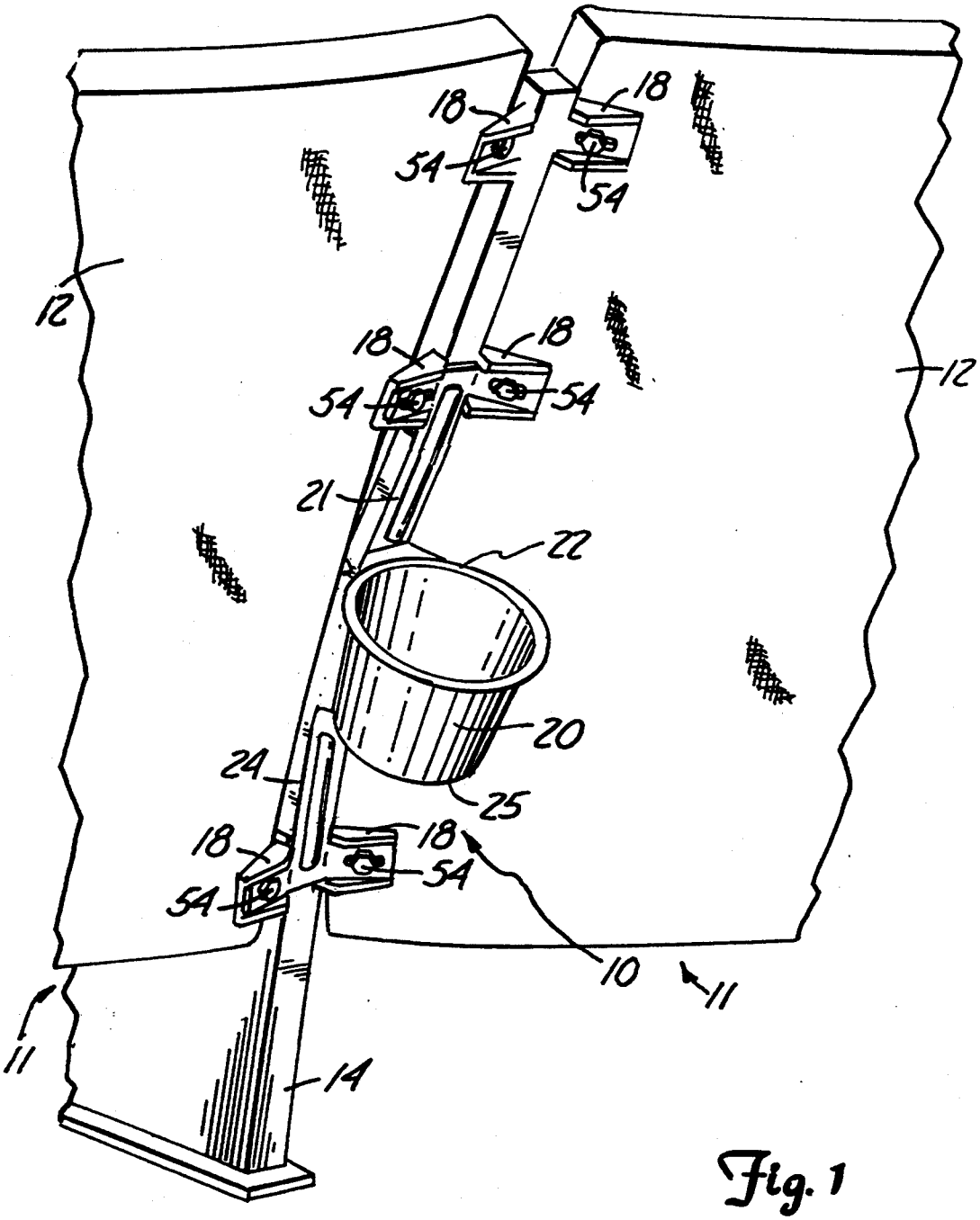
FIG. 1 is a perspective view of a portion of a seat having the seat attachment of the present invention mounted thereon.

A seat attachment 10 of the present invention is shown in FIG. 1 attached to two seats 11, each having a back 12 and attached to a standard 14. A plurality of seat brackets 18 which extend from the standard 14 are used to support the seat backs 12. The standard 14 and the seat brackets 18 are generally fabricated from a metal such as steel, aluminum or cast iron.

Figure 2:
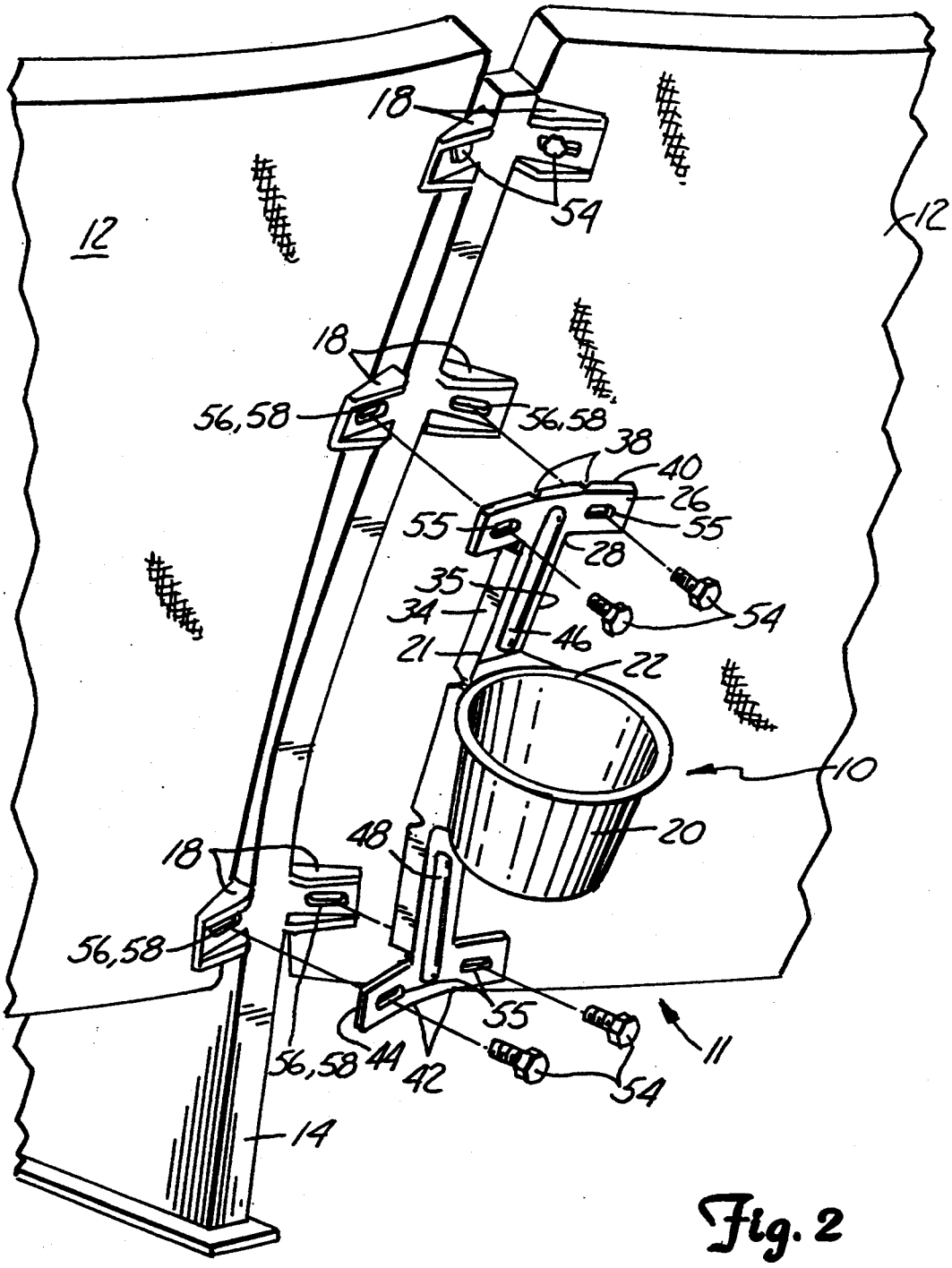
FIG. 2 is an exploded perspective view of a portion of the seat and the seat attachment of the present invention.

The seat attachment 10, which is shown in more detail in FIG. 2, is fabricated from a plastic such as polypropylene and comprises a generally cylindrical cupholder 20 having a first arm 21 extending from a generally open upper end 22 and a second arm 24 extending from a lower end 25. A first mounting bracket 26 is located at a first end 28 of the first arm 21 while a second mounting bracket 30 is located at a first end 32 of the second arm 24, each bracket providing laterally extending ears.

A first support wall or retainer 34 and a second support wall or retainer 35 protrude from both the first arm 21 and the second arm 24, respectively, and each extends along the respective first and second arm 21 or 24 between the first mounting bracket 26 and the second mounting bracket 30. When the seat attachment 10 is mounted on the standard 14, the first support wall 34 and the second support wall 35 come into contact with opposite sides of the standard 14 to prevent lateral motion of the seat attachment 10, holding or retaining it in place.

A first pair of parallel grooves 38 are located in a first side 40 of the first mounting bracket 26 while a second pair of parallel grooves 42 are located in a first side 44 of the second mounting bracket 30. The grooves 38,42 help enable the first and second mounting brackets 26,30 to conform to the shape of the seat brackets 18. A first stiffening rib 46 extends substantially the entire length of the first arm 21 while second stiffening rib 48 extends along substantially the entire length of the second arm 24. The stiffening ribs 46,48 help to strengthen the first and second arms 21,24 respectively.

Figure 3:
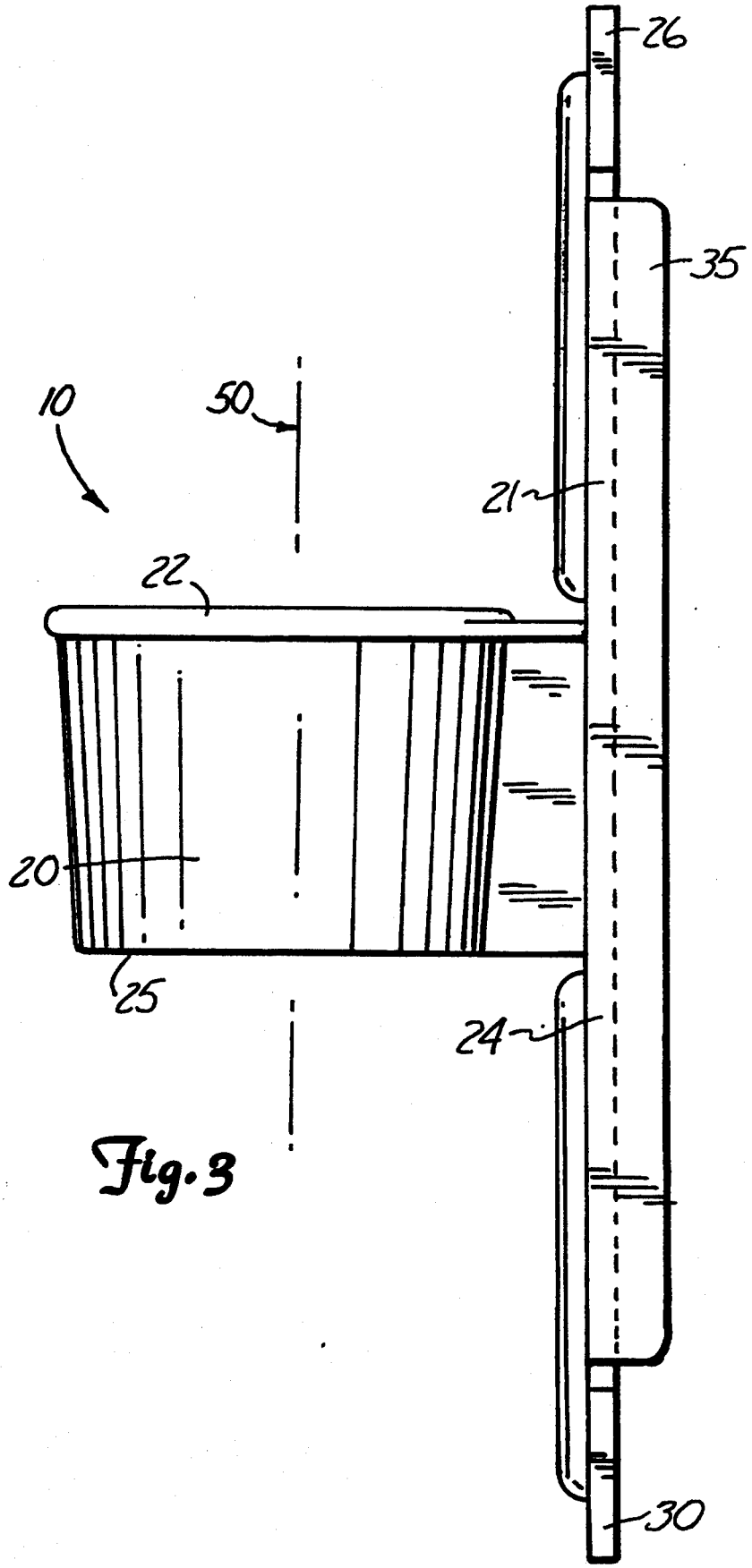
FIG. 3 is a side view of the seat attachment of the present invention.

The seat attachment 10 is shown in FIG. 3 as it appears before it is mounted on the standard 14. Both the first arm 21 and the second arm 24 extend in a direction generally parallel to a central axis 50 of the container holder 20. In addition, both the first mounting bracket 26 and the second mounting bracket 30 are flat and both are located in the same plane as the first arm 21 and the second arm 24.

Two bolts 54 are used to attach the first mounting bracket 26 to the standard 14 and the seats 11. Each bolt 54 extends through a mounting hole 55 in the first mounting bracket 26, through a corresponding hole 56 in one of the seat brackets 18, and is inserted into a pre-existing hole 58 in one of the seats 11. The second mounting bracket 30 is also attached to the standard 14 and to the seats 11 through the use of two bolts 54 to retain the container holder in a fixed position. Each bolt 54 extends through a mounting hole 55 in tie second mounting bracket 30, through a corresponding hole 56 in one of the seat brackets 18 and is inserted into a pre-existing hole 58 in one of the seats 11.

As the bolts 54 are tightened, the first and second mounting brackets 26,30 and the first and second arms 21,24 will bend. The first mounting bracket 26 and the second mounting bracket 30 will bend to conform to the general shape of the seat brackets 18 to which they are attached. The first arm 21 and the second arm 24 will bend to generally conform to the shape of the standard 14 on which the seat attachment 10 is mounted. The container holder 20 is thus drawn closer to the standard 14, substantially preventing it from protruding into the aisle behind the backs 12 of the seats 11.

By attaching the seat attachment 10 directly to the seat brackets 18, no new holes need to be drilled in the seats 11. In addition, the bolts 54 used can be the same bolts that are used to attach the seat backs 12 to the standard 14. The bolts 54 are first removed from the seat brackets 18 and the seat backs 12, the seat attachment 10 is then put in place and the bolts 54 are inserted as previously described.

The spacing between the pairs of seat brackets 18 on the standard 14 varies between seat manufacturers. To accommodate the various spacings, both the first arm 21 and the second arm 24 can be made to have a variety of lengths without changing their overall design. The size and shape of the first and second mounting brackets 26,30 shown match the size and shape of the seat brackets 18 generally used by seat manufacturers. However, the first and second mounting brackets 26,30 can be fabricated in a variety of sizes and shapes to correspond with a variety of seat brackets 18.

In a first alternative embodiment of the present invention, shown in FIGS. 4 and 5, a seat attachment 63 comprises a generally cylindrical container holder 64, a first arm 66 extending from an upper end 67 of the container holder 64 and an adjustable second arm 68 extending from a lower end 69 of the container holder 64. A sleeve 70 is attached to a first side 72 of the container holder 64 and the second arm 68 is inserted into the sleeve 70. The second arm 68 can slide within the sleeve 70 to vary the distance that the second arm 68 extends from the container holder 64. By adjusting the length of the second arm 68 in this manner, the seat attachment 63 can be adapted to be mounted on standards having seat brackets with a variety of spacings.

The second arm 68 is held fixed with respect to the sleeve 70 by a tightening nut 74 which extends through a first hole 76 in the sleeve 70, through an elongated slot 78 in the second arm 68 and into a second hole 80 in the sleeve 70. When the tightening nut 74 is loosened, the second arm 68 is free to slide in the sleeve 70. When the tightening nut 74 is removed, the second arm 68 can be completely removed from the sleeve 70. The remainder of the seat attachment 63 is substantially the same as that of the seat attachment 10 described in the first embodiment.

Although the present invention has been described with reference to preferred embodiments, workers skilled in the art will recognize that changes may be made in form and detail without departing from the spirit and scope of the invention.

What is claimed is:

1. A drink container holder for mounting onto a generally upright seat standard used for supporting a seat back and seat laterally of the standard, comprising:

a receptacle having a generally open first upper end and a second lower end opposite the first upper end spaced from the first upper end in a direction along a generally upright container holder axis;

a first bracket extending from the upper end of the receptacle in a direction along the container holder axis, said bracket having side edges and ear portions extending laterally of said side edges for mounting the receptacle to the seat standard; and a second bracket extending from the second end of the container holder in a direction along the container holder axis for mounting the receptacle to the seat standard, the second bracket having side edges and ear portions extending laterally of said side edges.

2. The apparatus of claim 1 and retaining means for holding the receptacle in substantially fixed relation to the seat standard.

3. The apparatus of claim 2 wherein the retaining means comprises a first support wall and a second support wall, each of which extends along the length of the receptacle brackets.

4. The apparatus of claim 1 wherein the first bracket comprises a first flexible elongated arm extending upwardly from the first end of the receptacle.

5. The apparatus of claim 4 wherein the second bracket comprises a second flexible elongated arm extending from the second end of the receptacle.

6. The apparatus of claim 5 wherein a first flexible mounting bracket is located at a first end of the first flexible arm and a second flexible mounting bracket is located at a first end of the second flexible arm.

7. The apparatus of claim 5 wherein the container holder has a general shape of a cylinder and the first end of the container holder faces generally upward.

8. The apparatus of claim 1, wherein the seat attachment is fabricated from polypropylene.

9. The apparatus of claim 5 and adjusting means for permitting the adjustment of the distance that the second arm extends from the second end of the receptacle.

10. The apparatus of claim 9 wherein the adjusting means comprises a sleeve attached to a first side of the receptacle and tightening means for holding the second arm fixed relative to the sleeve.

11. The apparatus of claim 10 wherein the tightening means comprising a tightening nut.

12. The apparatus of claim 11 wherein the second arm has an elongated slot therein and the tightening nut extends through a first opening in the sleeve, through the slot, and into a second opening in the sleeve.

13. A seat attachment in combination with a seat standard, the seat standard being attachable to a support surface and being generally upright and having at least one upper seat bracket extending laterally therefrom to opposite sides of the standard for supporting separated seat backs for a pair of adjacent seats forwardly of the seat bracket the seat attachment comprising:

a container holder having a generally open upwardly facing first end;

a mounting bracket attached to the container holder and having an upper end spaced from the first end of the container holder and having means for mounting the mounting bracket to the upper seat bracket to support the container holder behind the seat bracket; and a retainer attached to the container holder and attached to portions of the standard for holding the container holder in substantially fixed relation to the standard.

14. A drink container holder for mounting onto a generally upright seat standard, said standard having a pair of vertically spaced seat brackets extending laterally therefrom to support a seat back in a generally upright position laterally of the standard, the drink container holder comprising:

an open top receptacle having a lower end opposite the open top for supporting a drink container in the receptacle;

a first upper mounting bracken extending in a direction upwardly from the open top of the receptacle for mounting onto an upper one of said pair of seat brackets on the standard; and a second lower mounting bracket connected to the second end of the receptacle and being located for mounting the receptacle to the second lower one of said pair of seat brackets on the standard, wherein the mounting brackets comprise an upper and a lower arm each having an end spaced from the receptacle, respectively, and a separate mounting ear portion at the end of each of the arms, the mounting ear portions at the ends of the arms being configured to mate with the seat brackets and including apertures for receiving bolts used for mounting said seat back to the seat brackets on the standard.

* * * * *

UNITED STATES PATENT AND TRADEMARK OFFICE

CERTIFICATE OF CORRECTION

PATENT NO. : 5,421,638

DATED : June 6, 1995

INVENTOR(S) : Ayotte et al.

It is certified that error appears in the above-indentified patent and that said Letters Patent is hereby corrected as shown below:

Column 5, line 16, delete "said standard".

Column 6, line 4, delete "bracken" and insert --bracket--.

Signed and Sealed this

Twenty-first Day of May, 1996

Bruce Lehman

*Attest:*

BRUCE LEHMAN

*Attesting Officer*

*Commissioner of Patents and Trademarks*